US007842917B2

(12) United States Patent
McLuckey et al.

(10) Patent No.: US 7,842,917 B2
(45) Date of Patent: Nov. 30, 2010

(54) METHOD AND APPARATUS FOR TRANSMISSION MODE ION/ION DISSOCIATION

(75) Inventors: Scott A. McLuckey, West Lafayette, IN (US); Xiaorong Liang, Madison, WI (US); Yu Xia, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 336 days.

(21) Appl. No.: 11/998,306

(22) Filed: Nov. 29, 2007

(65) Prior Publication Data

US 2008/0128611 A1 Jun. 5, 2008

Related U.S. Application Data

(60) Provisional application No. 60/872,356, filed on Dec. 1, 2006.

(51) Int. Cl.
*H01J 49/26* (2006.01)
*H01J 49/00* (2006.01)

(52) U.S. Cl. ..... 250/283; 250/288; 250/282; 250/292

(58) Field of Classification Search ..... 250/283, 250/281, 292, 285, 282, 288
See application file for complete search history.

(56) References Cited

U.S. PATENT DOCUMENTS 6,483,109 B1 11/2002 Reinhold et al.
6,566,651 B2 * 5/2003 Baba et al. ..... 250/281
6,720,554 B2 4/2004 Hager
7,060,972 B2 6/2006 Hager
7,227,130 B2 * 6/2007 Hager et al. ..... 250/282
7,361,888 B1 * 4/2008 Boyle et al. ..... 250/285
7,365,319 B2 * 4/2008 Hager et al. ..... 250/292
7,456,397 B2 * 11/2008 Hartmer et al. ..... 250/292
2003/0052264 A1 * 3/2003 Baba et al. ..... 250/281

(Continued)

FOREIGN PATENT DOCUMENTS

EP 1 339 088 A2 8/2003

(Continued)

OTHER PUBLICATIONS

International Search Report from PCT international application No. PCT/US2007/024613 dated Jan. 15, 2009 (3 pages).

(Continued)

*Primary Examiner*—Jack I Berman
*Assistant Examiner*—Johnnie L Smith
(74) *Attorney, Agent, or Firm*—Brinks Hofer Gilson & Lione

(57) ABSTRACT

A method an apparatus for analyzing biomolecules is described. The method includes injecting and storing one species of ionized molecule in a linear ion trap and injecting second species of oppositely polarity ionized molecule such that the second species is transmitted through the stored first species. The resultant reaction products may be analyzed by a mass analyzed taking account of the remaining charge values. In an aspect, a linear ion trap may be used as the reaction volume, and the ionized species injected along the axis of the trap in a substantially collinear manner. The mass analysis may be performed by mass selective axial ejection or by a mass spectrometer.

24 Claims, 10 Drawing Sheets

U.S. PATENT DOCUMENTS

| | | | | |
|---|---|---|---|---|
| 2005/0263697 | A1* | 12/2005 | Hager et al. | 250/292 |
| 2007/0018094 | A1* | 1/2007 | Hager et al. | 250/292 |
| 2007/0045531 | A1* | 3/2007 | Mordehai et al. | 250/285 |
| 2007/0069124 | A1 | 3/2007 | Baba et al. | |
| 2008/0067342 | A1 | 3/2008 | Ding | |
| 2008/0073498 | A1* | 3/2008 | Kovtoun | 250/282 |
| 2008/0128610 | A1* | 6/2008 | McLuckey et al. | 250/283 |
| 2008/0128611 | A1* | 6/2008 | McLuckey et al. | 250/283 |
| 2008/0203288 | A1* | 8/2008 | Makarov et al. | 250/282 |
| 2008/0245963 | A1* | 10/2008 | Land et al. | 250/288 |

FOREIGN PATENT DOCUMENTS

| | | | |
|---|---|---|---|
| WO | WO 92/14259 | | 8/1992 |
| WO | WO 2004/063702 | A2 | 7/2004 |

OTHER PUBLICATIONS

International Search Report from PCT International Application No. PCT/US2008/087099 dated Jul. 20, 2009, 3 pages.

Written Opinion of the International Searching Authority for International Application No. PCT/US2008/087099, dated Jul. 20, 2009, 4 pages.

Liang, Xiaorong et al., "Transmission Mode Ion/Ion Electron-Transfer Dissociation in a Linear Ion Trap," © 2007 American Chemical Society, Analytical Chemistry, vol. 79, No. 9, May 1, 2007, pp. 3363-3370.

Pitteri, Sharon, J., et al., "Recent Developments in the Ion/Ion Chemistry of High-Mass Multiply Charged Ions," published online Feb. 10, 2005 in Wiley InterScience, www.interscience.wiley.com, Mass Spectrometry Reviews, 2005, 24, pp. 931-958.

Syka, John, E.P., et al., "Peptide and protein sequence analysis by electron transfer dissociation mass spectrometry," Proc. Nat. Acad. Sci. U.S.A., 2004, 101, 9528-9533, pp. 1-7.

Wu, Jin, et al., "Positive Ion Transmission Mode Ion/Ion Reactions in a Hybrid Linear Ion Trap," Anal. Chem. 2004, 76, pp. 5006-5015.

International Search Report from PCT international application No. PCT/US2007/024616 dated Nov. 27, 2008 (4 pages).

Written Opinion of the International Searching Authority for International Application No. PCT/US2007/024616, dated Nov. 27, 2008, 8 pages.

* cited by examiner

METHOD AND APPARATUS FOR TRANSMISSION MODE ION/ION DISSOCIATION

This application claims the benefit of U.S. provisional application No.: 60/872,356, filed on Dec. 1, 2006, which is incorporated herein by reference.

TECHNICAL FIELD

This application relates to an apparatus and method of analyzing molecules and, in particular, biomolecules.

BACKGROUND

Electron capture dissociation (ECD) and electron transfer dissociation (ETD) have been employed as structural interrogation tools to analyze biomolecules, particularly proteins and peptides. Both dissociation methods have shown extensive cleavage of the peptide back-bone bonds while preserving post-translational modifications (PTMs) arising from, for example, phosphorylation and glycosylation. The major structurally informative dissociation channels in both ECD and ETD often give rise to complementary c- and z-type fragment ions, while conventional ion activation methods, such as collision-induced dissociation or infrared multi-photon dissociation, give b- and y-type fragment ions. The latter dissociation methods often suffer from the difficulty of identifying the site of modification due to the propensity for cleaving PTMs.

Efficient ECD is mainly implemented in one form of mass spectrometry, that is, Fourier transform ion cyclotron resonance mass spectrometry, although some experiments describing the implementation of ECD in electrodynamic ion traps have been reported. ETD resulting from electron transfer via ion/ion reaction, is readily effected in electrodynamic ion traps, including quadrupole 3-D ion traps and linear ion traps (LITs). Due to its greater ion capacity and higher capture efficiency for injected ions, the LIT has advantages over the 3-D ion trap. Several ways of effecting ion/ion electron transfer dissociation reactions within a LIT are known, where both polarity ions can be produced and injected into the LIT from the axial direction, as shown in FIG. 1. One involves the storage of neither ion polarity and relies on reactions taking place between the ions of opposite polarity as they are continuously admitted into the LIT (Method A). The likelihood for ion/ion reactions in this mode is expected to be low as the relative velocities of the ions are high.

Another method (Method B) employs mutual storage of oppositely charged ions, which is expected to provide low velocities. However, this method requires the application of radio frequency (RF) voltages to the containment lenses of the LIT or the application of unbalanced RF voltages to the quadrupole array.

Ion/ion electron transfer dissociation reactions performed in a LIT have employed the mutual storage mode. Previous work demonstrated the use of positive ion transmission/negative ion storage mode for ion/ion proton-transfer reactions in a LIT by using electrospray ionization (ESI) and atmospheric sampling glow discharge ionization (ASGDI) sources. However, no ion/ion electron-transfer reactions appear to have been effected.

SUMMARY

A method of operating an ion trap is disclosed, the method including creating an ion trapping volume within a chamber of the ion trap; injecting a first population of ions into the ion trapping volume so that the first population is stored in the trapping volume and transmitting a second population of charged ions through the ion trap such that a physical overlap of the first and the second ion populations occurs.

In an aspect, an apparatus for analyzing molecules is disclosed, the apparatus including a linear ion trap (LIT), configured to accept and store a first population of ions; accept and transmit a second population of ions; and a mass analyzer, wherein one of the first ion population or the second ion population is analyzed by the mass analyzer.

DETAILED DESCRIPTION

Figure 1:
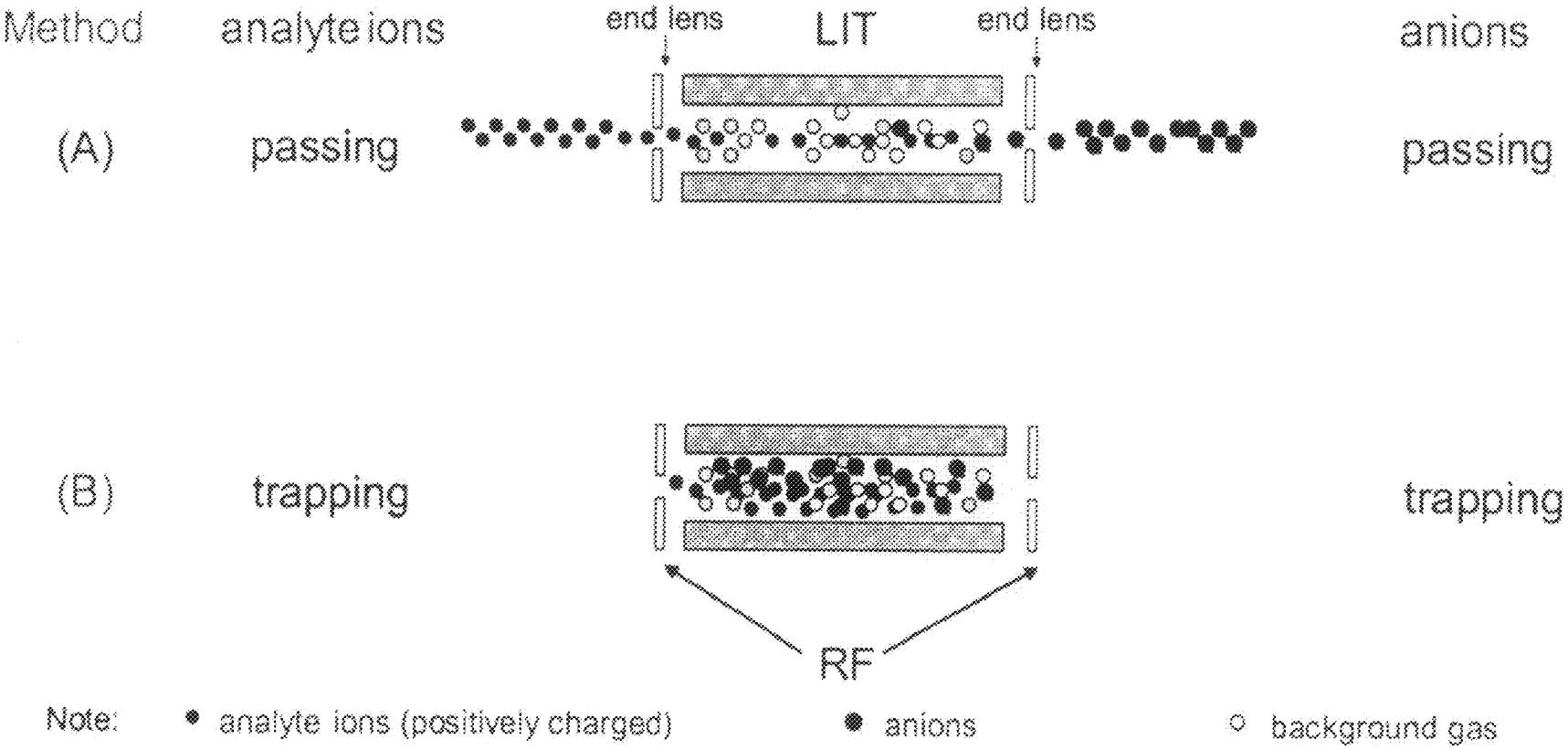
FIG. 1 (prior art)
FIG. 1 shows two known methods for effecting ion/ion electron transfer dissociation reactions in a linear ion trap (LIT): (A) passage of both polarity ions; and, (B) mutual storage of both polarity ions.
Figure 2:
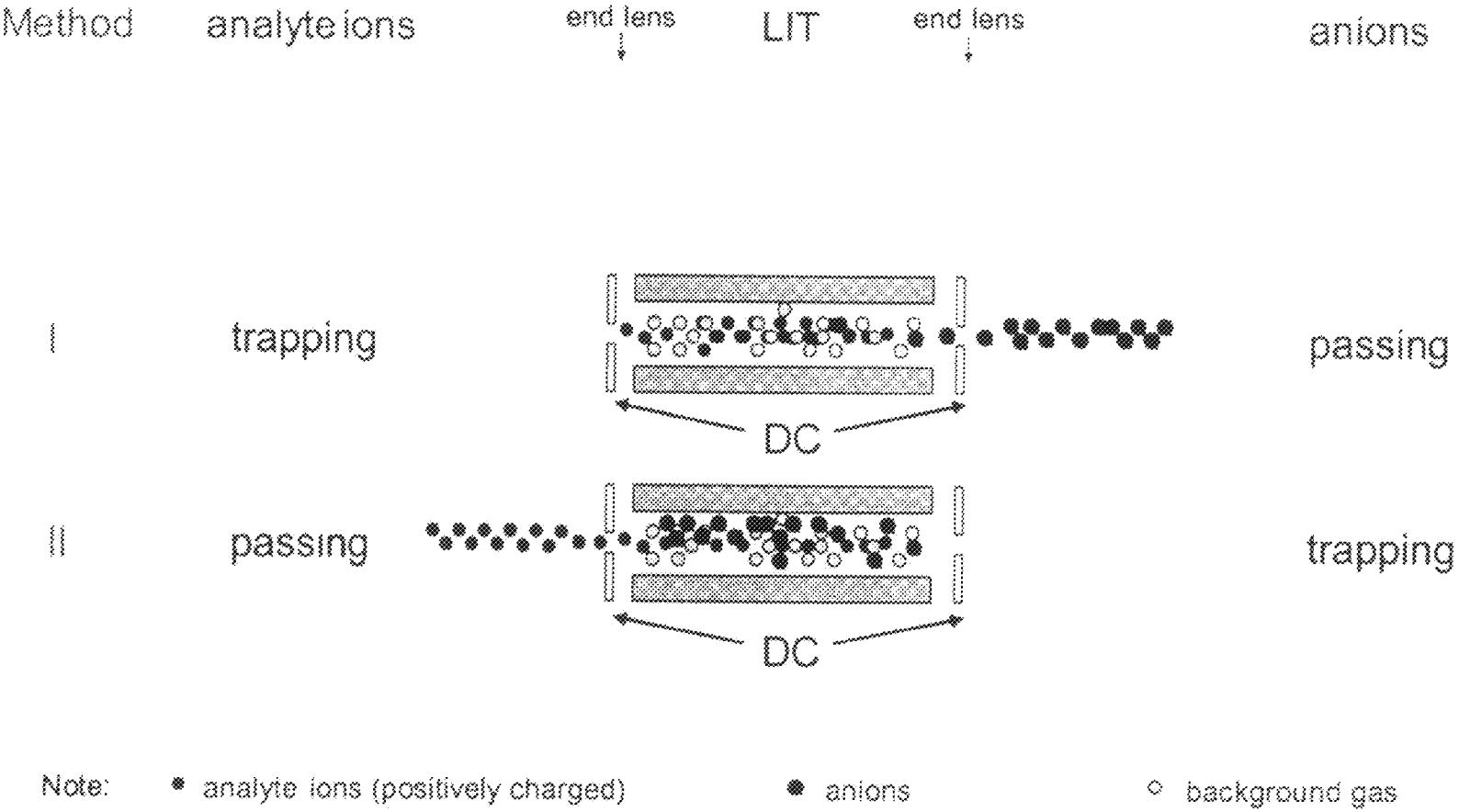
FIG. 2 shows two methods for effecting ion/ion electron transfer dissociation reactions in a linear ion trap (LIT): (A) positive ion storage/negative ion transmission; and, (B) positive ion transmission/negative ion storage.

Exemplary embodiments may be better understood with reference to the drawings, but these embodiments are not intended to be of a limiting nature. In the following description, numerous specific details are set forth in order to provide a thorough understanding of the present invention which, however, may be practiced without some or all of these specific details. In other instances, well known process operations have not been described in detail in order not to unnecessarily obscure the description.

Chemical phenomenologies may be studied by storing ions of one polarity in an electrodynamic ion trap and transmitting ions of opposite polarity through the ion trap such that there is spatial overlap in the oppositely charged ion populations. Several transmission mode ion/ion reaction methods are described, some of which involve electron transfer, and some of which involve other types of reactions.

In an aspect, two related methods for effecting electron transfer dissociation (ETD) are described that involve either the storage of analyte cations in a linear ion trap while reagent anions are transmitted through the cations or storage of the reagent anions with transmission of the analyte cations. That is, the methods involve storing one ion polarity while ions of the opposite polarity are admitted to the linear ion trap. In the method and apparatus disclosed herein, a linear ion trap is placed in series with the ion trap where the ion/ion reaction was employed. A pulsed dual-ion-source approach coupled with a hybrid triple quadrupole/linear ion trap (LIT) instrument is used. The two approaches appear to yield similar results in terms of the identities and relative abundances of the ETD products. The two methods may also give comparable extents of ion/ion reactions for the same reaction time. The conversions of precursor ions to product ions over the same reaction time are similar to those observed via the known mutual ion polarity storage experiments. However, transmission mode methods do not require the simultaneous storage of oppositely charged ions.

In a first method, positively charged ions are stored in a pressurized linear ion trap (LIT) while electron-transfer reagent anions are transmitted through the device. A second method includes storage of the electron-transfer reagent anions in the linear ion trap while multiply-protonated analyte ions are transmitted through the device. The latter method may use collection or mass analysis of the ETD products in an external device, since the LIT may be operated in anion storage mode.

The transmission mode ETD reaction is facilitated by a dual nano-ESI/APCI source, which alternatively generates and injects the analyte and electron-transfer reagent ions into the LIT. Other combinations of ion sources may be used to provide the analyte and reagent ions suitable for injection into one end of a LIT. The extent of ion/ion reaction for the two methods may be similar when each was conducted under optimized conditions. Similar ion/ion reaction periods may be used and the results may be comparable to those acquired using the known mutual storage mode, both in terms of efficiency and information content of the spectra. The transmission mode ETD methods do not require measures to be taken to allow for the mutual storage of both ion polarities.

In another aspect, the second method (viz., store reagent anions and transmit analyte cations) may be used in conjunction with a linked scan beam-type method. The transmission mode ETD method provides more parametric options when using ion/ion reactions to probe peptide ion structures. While the methods are described here with a hybrid triple quadrupole/LIT apparatus, they can be used with any type of instrument that employs a quadrupole collision cell. The "transmission mode" methods may not require the superposition of RF to the containment lenses of the LIT.

The experimental materials used were methanol and glacial acetic (Mallinckrodt, Phillipsburg, N.J.); Azobenzene (Sigma-Aldrich, St. Louis, Mo.), used as received; the peptide KGAILKGAILR was synthesized by SynPep (Dublin, Calif.); phosphopeptide TRDIpYETDYYRK (AnaSpec, San Jose, Calif.), and used without further purification. Solutions of peptides were dissolved to 10 μM in a 48/48/2 (vol/vol/vol) methanol/water/acetic acid solution for positive nano-ESI.

Figure 3:
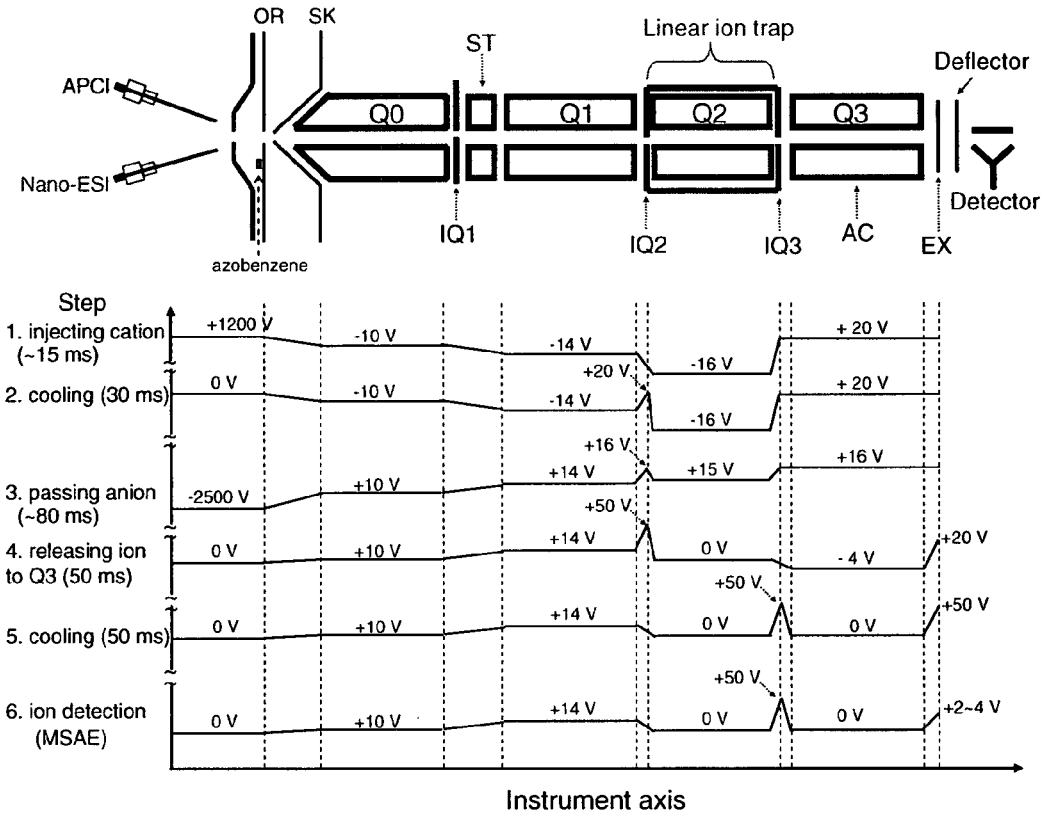
FIG. 3 is a simplified schematic of the Q TRAP mass spectrometer having a dual nano-ESI/APCI source; and, corresponding typical potentials along the apparatus axis at different steps (first step=top, last step=bottom) for ion/ion an electron-transfer reaction experiment using a first method.

Experiments were performed using a prototype version of a Q TRAP mass spectrometer (Applied Biosystems/MDS SCIEX, Concord, Ontario, Canada) equipped with an experimental dual nano-ESI/APCI (atmospheric pressure chemical ionization) source, as shown schematically in FIG. 3. The electronics were controlled by Daetalyst 3.10 software, a research version of software provided by MDS SCIEX.

The ion path was based on that of a triple quadrupole mass spectrometer with the last quadrupole rod array configured to operate either as a conventional RF/DC mass filter or as an LIT with mass-selective axial ejection (MSAE). The Q TRAP operated at a drive RF frequency of 650 kHz. Two ion sources were disposed at one end of the device, so as to inject ionized cations or anions of various species into the device. The ions may be singly or multiply charged, and the sense of the charge may be the same or different for the two ion sources.

The ions travel through a curtain gas and differential pumping regions into a quadrupole ion guide (Q0). The Q0 chamber and the analyzer chamber were separated by a differential pumping aperture, IQ1. The analyzer chamber contained three round-rod quadrupole arrays in series: an analyzing quadrupole Q1, a collision-cell quadrupole (Q2), and an analyzing quadrupole (Q3). Each of the quadrupoles was 127 mm in length with a field radius of 4.17 mm. A short RF-only Brubaker lens (ST), located in front of the Q1 RF/DC quadrupole, was capacitively coupled to the Q1 drive RF power supply. The collision cell (Q2) was used as a linear ion trap (LIT) with the IQ2 and IQ3 lenses located at either end. Nitrogen gas was introduced into Q2 via a high-precision valve and used as the primary collision gas. Gas pressure within Q2 was calculated from the conductance of IQ2 and IQ3 and the known pumping speed of the turbo molecular pumps. Q2 serves as an LIT by raising/lowering the IQ2 and IQ3 DC potentials for positive and negative ions, respectively.

The Q3 quadrupole was constructed from round gold-coated ceramic rods. Downstream of Q3 there were two additional lenses, the first with a mesh-covered 8-mm-diameter aperture, and the second with an open 8-mm aperture. These lenses are referred to as the "exit lens" and "deflector", respectively, in FIG. 3. Generally, the deflector was held at about 200 V more attractive with respect to the exit lens in order to extract ions from the Q3 LIT toward the ion detector, an ETP (Sydney, Australia) discrete dynode electron multiplier. The detector was operated in pulse counting mode with the entrance floated to −6 kV for positive ion detection and +4 kV for negative ion detection. An auxiliary RF voltage applied to Q3 was ramped in proportion to mass/charge (m/z) during the analytical scans. The ions trapped within the Q3 LIT were resonantly excited by a 380-kHz signal and mass-selectively ejected axially.

The Q2 and Q3 quadrupole arrays are configured as LITs and operated at a RF drive of 1 MHz while Q0 and Q1 quadrupole arrays are operated at a RF drive of 650 kHz.

In an example, a scan sequence for the first transmission mode ion/ion electron-transfer method (viz., store analyte cations, transmit reagent anions) includes positive ion injection into Q2 (15-ms), anion injection to Q2 LIT (80-ms), and transfer of ion/ion reaction product ions to mass analyzer Q3 (50-ms) for mass analysis. FIG. 3 summarizes the voltages applied to the relevant ion optical elements of the system for steps in the process. The ordinate represents distance (not drawn to scale) with the dashed lines aligning with the corresponding ion optics elements shown above the plot. The abscissa is a series of voltage axes where a first step of the experimental sequence is represented at the top and a final step is at the bottom. The voltages are indicted as numerical values, and the curve is intended to schematically relate the changes in voltage along the apparatus axis to physical aspects of the apparatus.

In this example of a transmission mode ion/ion electron-transfer reaction experiment, a positive high voltage power supply connected to the nano-ESI wire was pulsed on to generate analyte ions. The analyte ions were isolated by Q1 operating in an RF/DC mode and injected axially into the Q2 LIT at a pressure of about 1-8 mTorr. These ions were kinetically cooled in Q2 for 30 ms, during which time the high voltage on nano-ESI wire emitter was turned off. After the cooling step, the power supply connected to the APCI wire, which was operated at a negative polarity, was triggered on to generate the electron transfer reagent anions. The reagent anions were isolated by Q1 operating in an RF/DC mode prior to entering the Q2 LIT with relatively low kinetic energies (Q2 DC offset was roughly 5 V attractive relative to the Q0 DC offset). Also, the DC potentials applied to the containment lenses (i.e., IQ2 and IQ3) of Q2 LIT were adjusted to a value that was about 1 V repulsive to the Q2 LIT DC offset. The 1 V difference in potential is sufficiently high to trap the cooled analyte ions in the axial dimension.

The reaction time for ion/ion electron transfer dissociation may be determined by the injection time of the anion into the Q2 LIT. After a defined anion transmission time, positively charged product ions arising from ion/ion electron-transfer reactions, as well as the residual precursor ions, were transferred from Q2 to Q3, and cooled for about 50 ms before they were subjected to mass selective axial ejection (MSAE) using a auxiliary RF signal at a frequency of 380 kHz.

Figure 4:
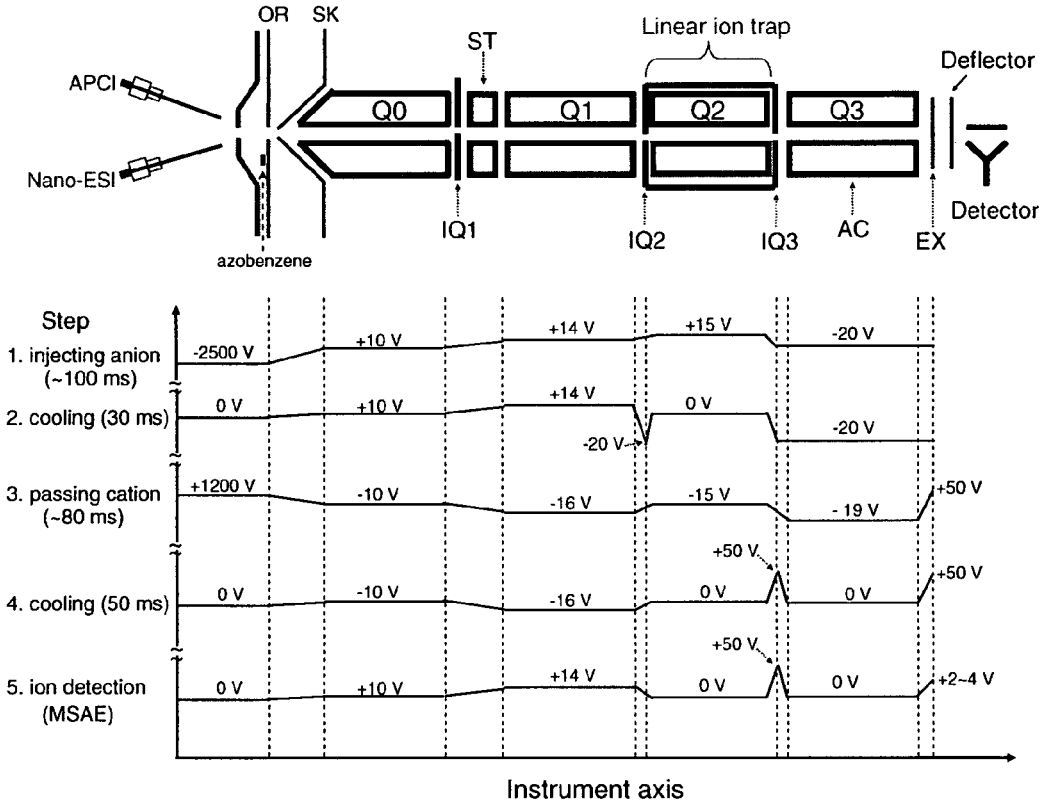
FIG. 4 is a simplified schematic of the Q TRAP mass spectrometer having an experimental dual nano-ESI/APCI source; and, corresponding typical potentials along the apparatus axis at different steps for ion/ion electron-transfer reaction experiments using a second method.

A typical scan function for the second method, whereby ETD reagent anions are stored in Q2 while multiply-protonated peptides or proteins are transmitted through Q2 with the collection of positively charged products in Q3, is shown in FIG. 4. The order in which anions and cations are formed in this experiment is inverted from that used with first method. In the case of second method, the reaction LIT (Q2) is used in the anion storage mode and Q3 is operated as a positive ion LIT to accumulate the ETD products and un-reacted precursor. This differs from the first method where the ETD products of interest are accumulated in the reaction LIT (Q2). The spectra shown here were typically the averages of 20-50 individual scans.

That is, the second method has a device allocated to the mass analysis of the ion/ion reaction product associated with the transmitted ions. The function in this apparatus is served by the LIT (Q3) adjacent to the reaction LIT (Q2). However, a time-of-flight mass spectrometer, an ORBITRAP mass spectrometer (available from Thermo Fisher Scientific, Inc., Waltham, Mass.), a quadrupole mass filter, an ion cyclotron resonance mass spectrometer, or the like, may be used.

Figure 5:
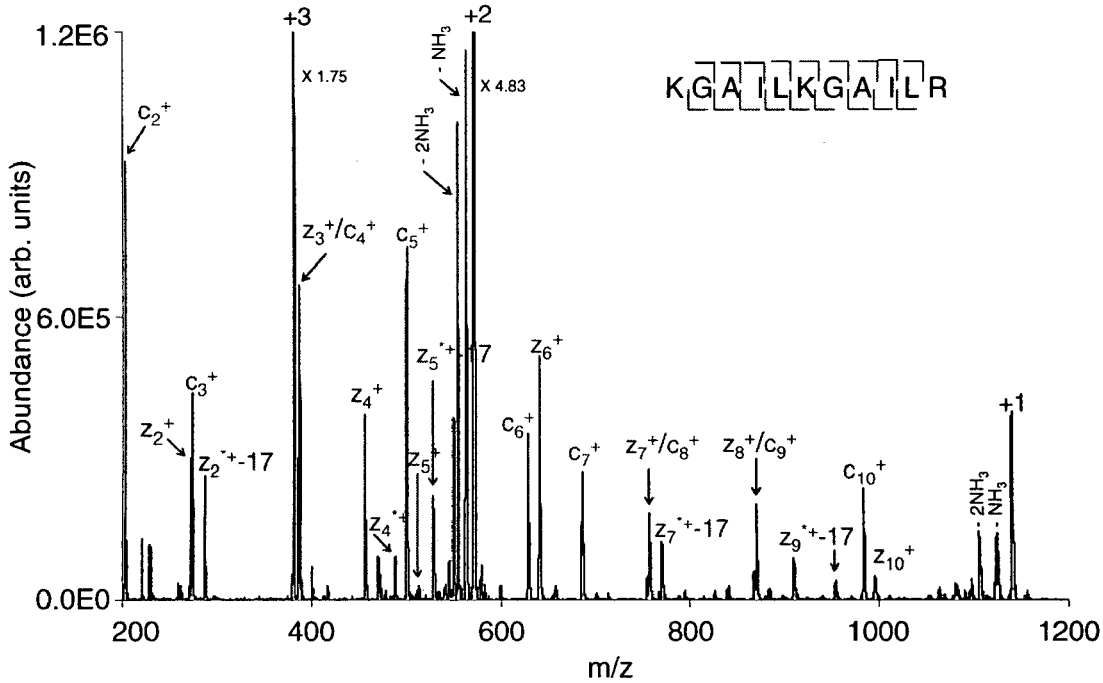
FIG. 5 shows experimental mass spectrum data using from the first method of transmission mode ion/ion electron-transfer reaction of triply-protonated peptide KGAILKGAILR $[M+3H]^{3+}$ trapped in Q2 LIT while passing azobenzene radical anions through the peptide for 80-ms.

The operation of both methods of transmission mode ion/ion electron-transfer reactions are illustrated in experimental examples using the triply-protonated model peptide KGAILKGAILR as the analyte cation and the azobenzene radical anion as the ETD reagent. Both polarity ions were alternatively generated and injected into Q2 by a dual nano-ESI/APCI source. FIG. 5 shows the post-ion/ion electron-transfer reaction mass spectrum resulting from the storage of triply protonated peptide KGAILKGAILR $[M+3H]^{3+}$ in Q2 while passing azobenzene radical anions through the Q2 LIT for 80-ms using the first method.

The injection q-value (a dimensionless parameter related to the amplitude of the trapping RF amplitude, RF frequency, mass-to-charge ratio of the ion, and inscribed radius of the quadrupole array) for the azobenzene anions was about 0.65 and the DC trapping voltage applied to both end lenses of Q2 was 1 V relative to the Q2 DC offset.

The RF frequency and inscribed radius were fixed, while the RF amplitude was variable and may be used to alter the q-values for the ions. The background gas pressure was about 8 mTorr.

The identities and the relative abundances of the ETD fragment ions resulting from this transmission mode ion/ion ETD reactions are similar to those reported in a three-dimensional ion trap and in a linear ion trap configured in a mutual storage mode. In addition to the c- and z-type fragment ions and neutral side chain losses, some z radical oxygen addition adducts (z*) and their dissociation products ($z^*-HO^{\cdot}$) were observed. The latter ions are formed via oxygen addition adducts.

Figure 7:
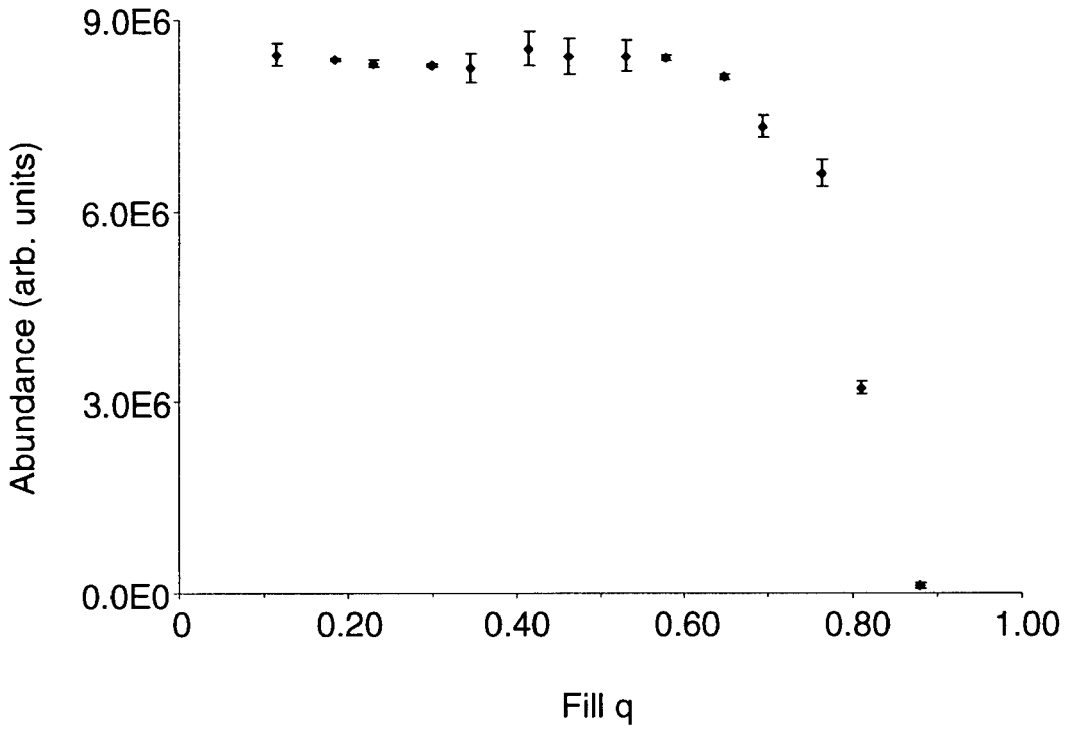
FIG. 7 shows the dependence of the ion intensity of azobenzene radical anions as a function of the injection q-value of the Q2 LIT; the anion injection time was 15-ms and Q1 quadrupole was set to pass the azobenzene radical anions.

Data collected with the same reactants using the second method, which involved storage of azobenzene radical anions in Q2, while passing triply protonated peptide KGAILKGAILR $[M+3H]^{3+}$ through the Q2 LIT for 80-ms, is shown in FIG. 7. The reaction q-value for the azobenzene anions during the passage of analyte ions was about 0.46 and the DC trapping voltage applied to both end lenses of Q2 for anions was 1 V relative to the Q2 DC offset. The background gas pressure was about 8 mTorr. Product ions resulting from ion/ion electron-transfer reactions, as well as residual parent ions, were transmitted through Q2 and collected in Q3, which was operated in LIT mode.

Figure 6:
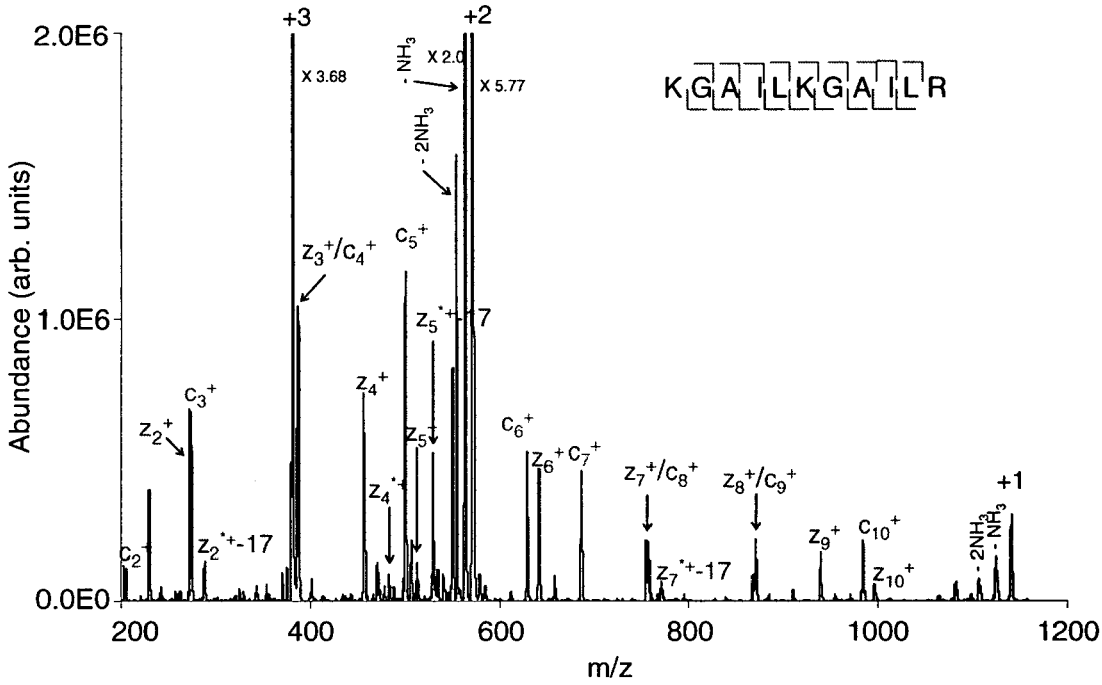
FIG. 6 shows experimental mass spectrum data using from the second method of transmission mode ion/ion electron-transfer reaction where azobenzene radical anions were trapped in Q2 LIT while transmitting triply-protonated KGAILKGAILR $[M+3H]^{3+}$ through Q2 for 80-ms; the product ions resulting from ion/ion electron-transfer reactions, as well as residual parent ions, were collected in Q3 LIT.

Under the conditions used to collect the data for FIGS. 5 and 6, comparable conversions of parent ions to product ions were observed and the identities and abundances of the ETD products were similar for the two methods.

Similar considerations may apply for optimizing conditions for the two methods. Factors considered may include the RF levels used in Q2 for the ion/ion reaction period, the kinetic energy of the transmitted ions, the DC levels used on the trapping lenses on either side of Q2, and Q2 pressure. These factors are discussed here with emphasis on the first method, which represents a transmission mode ion/ion reaction. The analyte ions, i.e., KGAILKGAILR $[M+3H]^{3+}$, were injected first into the Q2 LIT with a q-value (0.20~0.50) selected to achieve the highest ion collection efficiency. The analyte ions were kinetically cooled for about 30-ms and trapped in Q2 by applying a 1 V DC to both end lenses relative to the Q2 DC offset. The next step was the injection of azobenzene anions into Q2, which resulted in ion/ion reactions with the population of trapped analyte ions. Since the level of drive RF amplitude applied to the rods of the LIT during the period of the ion/ion electron-transfer reaction relates to the q-values for both the azobenzene anions and peptide cations, conditions suitable for the storage of the analyte ions while the anions can be transmitted such that there is a maximum in cation/anion overlap are determined.

FIG. 7 shows the dependence of azobenzene radical anion transmission through Q2 on the anion q-value. The data were obtained by admitting m/z 182 azobenzene anions into the Q2 linear trap pressurized to about 8 mTorr ($N_2$) at a series of drive RF amplitudes. The anions were trapped in Q2 by putting a stopping voltage on IQ3, and then transferred to Q3.

The signal strength of the m/z 182 ions was then measured via MSAE. Due to the geometry of the linear ion trap, injected ions enter very close to the zero-field centerline of the device.

Previous work on ion acceptance of a transmission RF-only quadrupole suggests very high radial containment efficiencies even at low injection q-values. Thus the ion abundance of azobenzene anions may be fairly constant over a range of injection q-values as long as regions of high RF amplitude are not sampled. Anion transmission is found to be roughly constant over a q-value range of 0.10 to 0.65.

The effect of azobenzene radical anion q-value on the storage of cations was also examined to determine if the use of relatively low q-values for azobenzene might lead to loss of the high mass-to-charge ratio cations stored in Q2. Both triply- and doubly-charged ions KGAILKGAILR ions may be stored in Q2 with abundance deviation of less than 10% over a range of azobenzene q-values of 0.10-1.0 (data not shown). The data of FIG. 7 and the results described suggest that a wide range of RF amplitudes can be used while accommodating the anions and cations for the ion/ion reaction experiment. The ion/ion reaction rate also depends upon the degree of overlap between the oppositely-charged ion populations. This overlap may be affected by the RF-amplitude as it may determine the depth of the trapping wells for the ions and, may affect the ion density at the center of the ion trap.

To evaluate the effect of the drive RF amplitude on the ion/ion electron-transfer reaction rate, the fill-time of analyte ions was set to a fixed value of 12-ms and the injection time for anions was set to 80-ms, while only the RF drive voltage was varied. In a series of experiments, the trapping voltage for analyte ions was set at 1 V (IQ2–RO2=1 V and IQ3–RO2=1 V) while passing the azobenzene anions through Q2 at a relatively low kinetic energy of 5 V (RO2–RO0=5 V).

Figure 8:
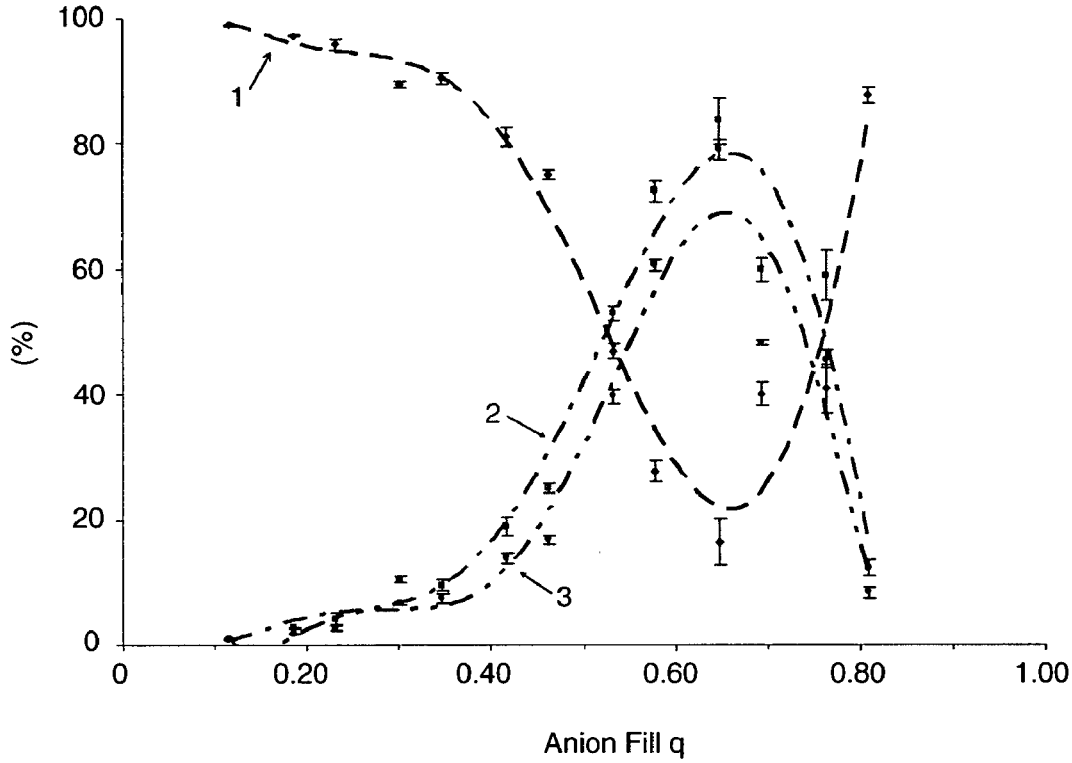
FIG. 8 shows the dependence of the ion intensity of ion/ion reaction products and the residual parent ions as a function of injection q-value of azobenzene radical anions after passing anions through a population of triply-protonated KGAILKGAILR trapped in the Q2 LIT for 80-ms: Curve 1: % residual parent ions; Curve 2: % Total Ion/ion; Curve 3: % Total ETD.

In FIG. 8, the percentage of remaining residual precursor ions (Curve 1), the percentage of the total ion signal represented by ion/ion reaction products (% Total Ion/ion, Curve 2), as well as the sum of the percentage of the total ion signal due to ETD (% Total ETD, Curve 3) were recorded and plotted as functions of the injection q-value of the azobenzene radical anions. The ion abundances were normalized to the sum of the abundance of all ion/ion products plus the abundance of residual parent ions. The abscissa values for Curve 2, for example, were determined from:

$$\%\,\text{Total.Ion/ion} = \frac{\sum(\text{post-ion/ion.products})}{\sum(\text{post-ion/ion.products}+\text{residual.precursor.ions})} \quad (1)$$

and those for Curve 3 were determined from:

$$\%\,\text{Total.ETD} = \frac{\sum(c,\ z,\ \text{neutral.side.chain.losses})}{\sum(\text{post-ion/ion.products}+\text{residual.precursor.ions})} \quad (2)$$

The difference between the two curves may reflect a contribution from ion/ion proton transfer and any electron transfer that may not lead to dissociation products. The relative contributions of the latter two channels do not appear to be sensitive to anion q-value over a range for which a significant extent of ion/ion reaction is observed. Of the ion/ion reactions, 73±10% (i.e., % Total ETD/(% Total Ion/ion)×100) result in formation of recognized ETD products (i.e., c-ions, z-ions, and side-chain losses known to arise from ETD) for this reaction pair. The results shown in FIG. 9 suggest focusing the two ion populations as much as possible to the center line of the LIT to maximize overlap and, as a result, ion/ion reaction rate. For this example, at least, the highest rates are observed at the highest anion q-values that do not lead to a decrease in anion transmission (see FIG. 8).

The second method (store analyte cations, transmit reagent anions) was initially performed in the relatively low pressure ($3\times10^{-5}$ Torr) Q3 LIT by storing triply-protonated peptides while continuously passing azobenzene radical anions through the LIT. Product ion signals resulting from ion/ion reactions were low. A difference between the Q2 LIT and the Q3 LIT is background pressure, which may suggest that pressure is a parameter to be controlled.

Ion/ion reaction experiments were carried out in Q2 over the accessible pressure range of 1-10 mTorr of nitrogen at an azobenzene molecular anion q-value of 0.65. No significant variation in % Ion/ion reaction (or % ETD) was observed (data not shown). This suggests that the pressure at which the % Ion/ion reaction reaches a plateau is less than 1 mTorr (or that there is some other unidentified factor that leads to relatively low transmission mode ion/ion reaction rates in the Q3 LIT). Ion/ion reaction rates in the known mutual storage mode in the Q2 LIT are generally at least an order of magnitude greater than in the Q3 LIT. The difference in reaction rates in the two LITs may therefore not be restricted to transmission mode methods.

Figure 9:
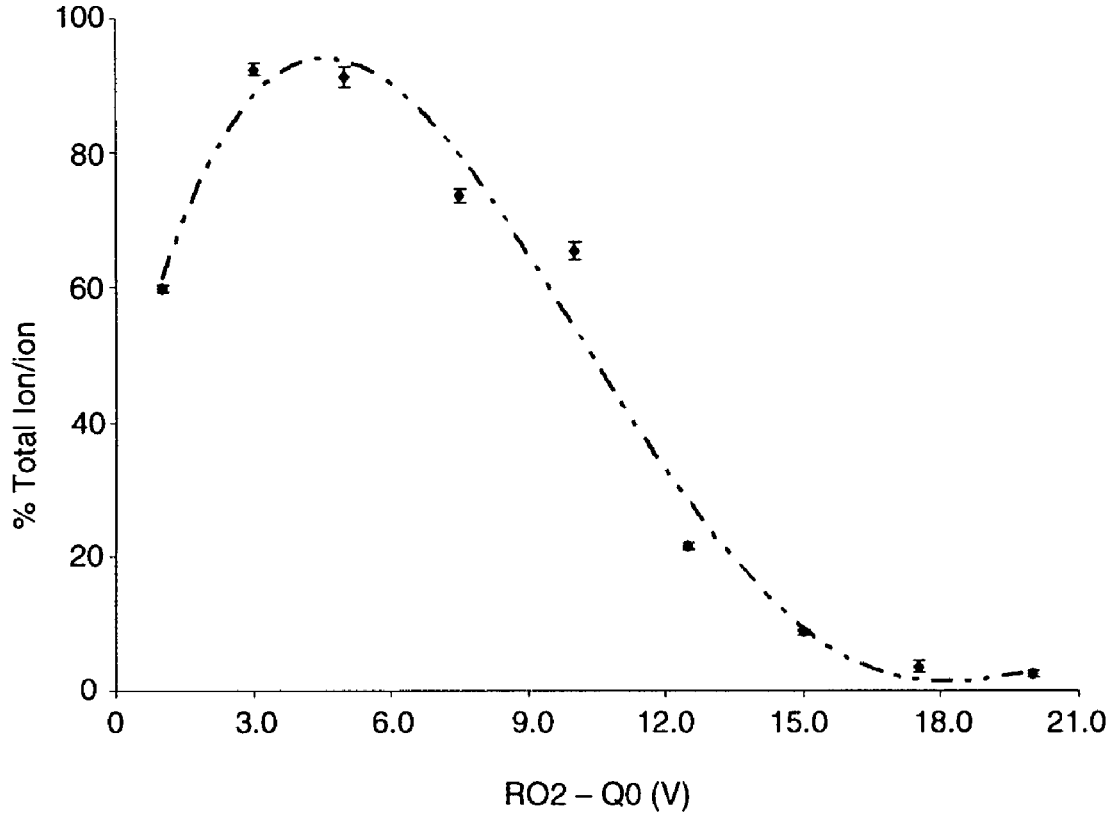
FIG. 9 shows the dependence of the % Total Ion/ion contribution as a function of the anion injection energy, as indicated by the difference in DC potentials of Q0 and Q2; an anion q-value of 0.65 was used during the 80-ms period in which azobenzene radical anions were transmitted through Q2, which was used to store a population of triply-protonated KGAILKGAILR; and, FIG. 10 shows experimental mass spectrum data derived from the first method of transmission mode ion/ion electron-transfer reaction of triply protonated phosphopeptide TRDIpYETDYYRK trapped in Q2 LIT while passing azobenzene radical anions through the phosphopeptide for 100-ms.

The effect of anion injection energy on % Total Ion/ion, as defined by the DC offset difference between Q0 and Q2, is shown in FIG. 9. A fairly broad maximum is observed between 3 and 10 V, which corresponds to 3-10 eV for the singly charged anions. A combination of factors is believed to contribute to the observed behavior. These may include, for example, energy dependent anion transmission through Q2, the dependence of ion/ion reaction rate on the relative velocities of the ions, and any relative translational energy effects on the overlap of the oppositely charged ions.

The data shown qualitatively tracks the energy dependent transmission of the anions (data not shown). The lower % Total Ion/ion at 1.0 eV, relative to the value for 3 eV, for example, may be accounted for by a lower anion transmission efficiency at 1.0 eV. However, at the higher energies, for example, 12 eV and above, the % Total Ion/ion values drop much more rapidly than does the observed anion transmission. While a decrease in Ion/ion overlap cannot be eliminated as a contributing factor to the observed decrease in the extent of Ion/ion reactions at the higher anion injection energies, a decrease in the cross-section for Ion/ion reaction may be expected as the relative velocity of the reactants increase.

The ions that enter Q2 may undergo multiple collisions, such that a major fraction of the anion kinetic energy may be expected to be lost during passage through Q2, due to momentum transfer collisions. However, the distribution of the relative velocities of the ionic reactants in Q2 may be expected to show some correlation with the anion injection energy. The results shown in FIG. 9 may provide empirical support for the use of 3-10 eV injection energies for performing the first method.

Another parameter that may affect the performance of transmission mode ETD in the LIT may be the trapping potential of analyte ions applied to the end lenses (IQ2 and IQ3) of Q2 LIT during the transmission time of azobenzene anions. The trapping potentials should be large enough to trap the kinetically cooled analyte ions as well as the product ions resulting from ion/ion electron-transfer reaction. However, relatively high potentials applied to these lens elements may lead to undesirable ion-optics effects for transmission of the anions. The optimum values for the potentials applied to the end lenses during the anion transmission period, in this example, were between 0.5 and 2 V relative to the RO2 DC offset.

Table 1 summarizes the set of operating conditions that represent suitable conditions for effecting ion/ion ETD reactions using the first method in Q2 with the present apparatus.

TABLE 1

Optimal conditions for Method I transmission mode ion/ion electron-transfer dissociation reaction experiments in the Q2 LIT.

| parameter | value |
|---|---|
| Background gas pressure | 1-8 mTorr |
| Cation injection | |
| RO0-RO2 | 4-10 V |
| fill q-value | 0.10-0.70 |
| Anion injection | |
| RO2-RO0 | 3-10 V |
| fill q-value | 0.10-0.70 |
| Reaction q-value of anion | 0.60-0.70 |
| Trapping voltage for cations during reaction period | |
| IQ2-RO2 | 0.5-2 V |
| IQ3-RO2 | 0.5-1.5 V |

ETD may be used as a tool for identifying sites of post-translational modifications, such as sites of phosphorylation, as cleavages tend to occur along the peptide backbone, thereby preserving information regarding the location of modified residues. Transmission mode ETD methods differ from mutual storage mode ETD experiments as there is, at least initially, greater relative translational energy in the transmission mode method. If some of the higher relative translational energy is coupled into internal modes of the Ion/ion reaction products, it may be possible that transmission mode and mutual storage mode ETD method could lead to differences in the dissociation behavior. This was not observed, however, for the KGAILKGAILR ions, for the particular experimental apparatus and parameters. However for other analyte ions, it may be of significance to determine if any differences between transmission mode and mutual storage mode ETD are observed for post-translationally modified species.

Figure 10:
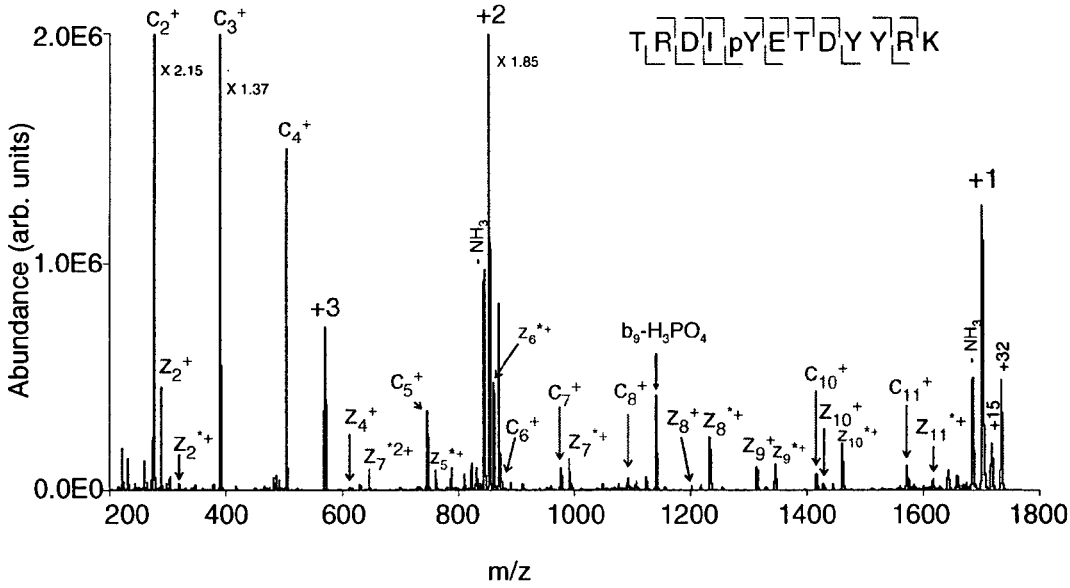

FIG. 10 shows data resulting from the application of ETD performed in the first method transmission mode to a phosphopeptide. The spectrum was obtained by storing triply-protonated TRDIpYETDYYRK in the Q2 LIT and passing the azobenzene anions through the stored ions for 100-ms. Electron transfer from the azobenzene anions may have given rise to c- and/or z-type fragments from inter-residue bond except the bond between two tyrosines, as well as fragments from arginine side chain loss. Some oxygen addition adducts and their dissociation products (loss of HO.) were observed for z radicals from the ETD fragments and for the +1 charged species. The location of the phosphate group is indicated by c-type fragment ions N-terminal to tyrosine ($c_4$-$c_5$) and z-type fragment ions C-terminal to tyrosine ($Z_7$-$Z_8$) that are 80 mass units higher than the corresponding unmodified peptide. Loss of the phosphate group from the $b_9$ ion was observed, which may be due to collision induced dissociation during the cation injection process into pressurized Q2 LIT. No evidence for the loss of the phosphate appears evident from the dissociation products expected to arise from ETD. Hence, the transmission mode ETD method may provide structural information comparable to that obtained via mutual storage mode ETD, for phosphorylated peptides.

In yet another aspect, a mixture of multiply protonated ions, such as those derived from a tryptic digest of a protein, can be accumulated and stored in an ion trap. The stored ions can then be ejected axially via mass-selective axial ejection (MSAE) through a second ion trap that stores a population of negatively charged electron transfer reagents. The positively charged ions that transmit through the second ion trap, including products from electron transfer dissociation and unreacted precursor ions, can pass to another mass analyzer, such as a time-of-flight mass spectrometer. This method may make efficient use of the ions when the initial mixture of positive ions comes from a pulsed ion source. Where ions are only being formed during the period in which the first ion trap is filled, substantially all of the ions stored in the first ion trap can be subjected to structural interrogation before a new population of ions is formed by the next ionization pulse.

In still another aspect, transmission mode Ion/ion reactions in which the analyte ions are the transmitted species are conducive to so-called "linked-scanning" techniques, which may be useful for mixture screening purposes.

For example, the so-called "parent ion scan" is one that identifies the precursor ions that react to give a common fragment. A parent ion scan can be implemented in connection with a transmission mode ETD method in which the transmitted ion is the multiply protonated species of interest. It may be possible to identify any peptide that has a specific residue at the N-terminus, when the second mass analyzer of a tandem mass spectrometer is set to pass ions of the mass-to-charge ration of $c_1$-type ion associated with the residue of interest. In this way, by scanning the first mass analyzer of the tandem mass spectrometer and transmitting the various peptide cations of interest in a mass dependent fashion through the ion trap that contains the stored electron transfer reagent anions, a spectrum of precursor ions that dissociate to give the specific $c_1^+$ fragment can be recorded.

In a further aspect, the inversion of charge of an analyte ion can be accomplished in a transmission mode ion/ion method by storing multiply charged reagent ions in an ion trap and transmitting the analyte ions. Some singly protonated analyte ions, for example, may undergo multiple proton transfer reactions with multiply-deprotonated reagent species to form negative ions. Such analyte ions may be trapped along with the stored negative reagent ions and can subsequently be mass-analyzed.

In yet another aspect, a first polarity of ions may be introduced to the LIT axially as described above, and a second polarity of ions introduced radially. In this arrangement, there need not be a time sequenced ion injection. That is, both polarities of ions can be admitted simultaneously to the LIT (e.g., reagent ions can be admitted continuously from the side and stored in the LIT Q2 while analyte ions are continuously transmitted through the LIT). Uninterrupted analyte transmission may be suitable for processes such as in-line liquid chromatography coupled with tandem mass spectrometry. Alternatively, one or more of the ion sources may be time sequenced.

A variety of other transmission mode ion/ion reaction experiments can also be performed, some of which involve electron transfer and some of which involve other types of reactions. For example:

1) a mixture of multiply-protonated ions, such as those derived from a tryptic digest of a protein, can be accumulated and stored in an ion trap. The stored ions can then be ejected axially via mass-elective axial ejection through a second ion trap that stores a population of negatively charged electron transfer reagents. The positively charged ions that are transmitted through the second ion trap, including products from electron transfer dissociation and un-reacted precursor ions, can pass to another mass analyzer, such as a time-of-flight mass spectrometer. This experiment may make efficient use of the ions when the initial mixture of positive ions comes from a pulsed ion source. If ions are only being formed during the period in which the first ion trap is filled, substantially all of the ions stored in the first ion trap may be subjected to structural interrogation before a new population of ions is formed by the next ionization pulse;

2) transmission mode ion/ion reactions in which the analyte ions are the transmitted species are applicable to so-called "linked-scanning" experiments, which have been shown to be useful for mixture screening purposes. For example, the so-called "parent ion scan" is one that observes all precursor ions that react to give a common fragment. A parent ion scan can be implemented with a transmission mode ETD experiment in which the transmitted ion is the multiply-protonated species of interest. If, for example, it is of interest to identify any peptide that has a specific residue at the N-terminus, the second mass analyzer of a tandem mass spectrometer can be set to pass ions of the mass-to-charge ration of $c_1$-type ion associated only with the residue of interest. In this way, by scanning the first mass analyzer of the tandem mass spectrometer and transmitting in a mass dependent fashion the various peptide cations of interest through the ion trap that contains the stored electron transfer reagent anions, a spectrum of all precursor ions that dissociate to give the specific $c_1^+$ fragment can be recorded; and, 3) the inversion of charge of an analyte ion may be accomplished in a transmission mode ion/ion experiment by storing multiply charged reagent ions in an ion trap and transmitting the analyte ions. For example, some singly-protonated analyte ions can undergo multiple proton transfer reactions with multiply-de-protonated reagent species to form negative ions. Such analyte ions will be trapped along with the stored negative reagent ions and can subsequently be mass-analyzed.

Although only a few examples of this invention have been described in detail above, those skilled in the art will readily appreciate that many modifications are possible without materially departing from the novel teachings and advantages of the invention. Accordingly, all such modifications are intended to be included within the scope of this invention as defined in the following claims.

What is claimed is:

1. A method of operating an ion trap, the method comprising:

creating an ion trapping volume within a chamber of the ion trap;

injecting a first population of ions into the ion trapping volume so that the first population is stored in the ion trapping volume; and transmitting a second population of charged ions through the ion trapping volume.

2. The method of claim 1, wherein the first ion population includes multiply charged positive ions and the second ion population includes singly-charged negative ions, and a physical overlap of the first and the second ion populations occurs.

3. The method of claim 2, wherein said first population of ions which carry multiple positive charges include a substance selected from the group consisting of peptides, proteins, oligonucleotides, oligosaccharides, and synthetic polymers.

4. The method of claim 2, further comprising producing said first population of ions which carry multiple positive charges by electrospray ionization.

5. The method of claim 1, wherein the first ion population of ions includes multiply charged negative ions, and the second ion population includes singly-charged positive ions.

6. The method of claim 1, wherein the first ion population includes singly charged negative ions, and the second ion population includes multiply charged positive ions.

7. The method of claim 1, wherein the first ion population includes multiply charged positive ions, and the second ion population includes multiply charged negative ions.

8. The method of claim 1, wherein the first ion population includes multiply charged negative ions and the second ion population includes multiply charged positive ions.

9. The method of claim 1, wherein after a period of time where the second ion population overlaps the first ion population, the first ion population is ejected into an external detector in a mass-to-charge dependent fashion.

10. The method of claim 1, wherein after a period of time where the second ion population overlaps the first ion population, the first ion population ions is allowed to enter a mass analyzer adjacent to the ion trap.

11. The method of claim 10, wherein the mass analyzer is any one of an ion trap, a time-of-flight mass spectrometer, an ORBITRAP mass spectrometer, a quadrupole mass filter, or an ion cyclotron resonance mass spectrometer.

12. The method of claim 1, wherein a mass analyzer is disposed between a source of ions and the ion trap and configured to select of ions of specific mass-to-charge ratios to enter the ion trap.

13. The method of claim 12, wherein the mass analyzer is a quadrupole mass filter.

14. The method of claim 1, further comprising obtaining a mass spectrum of one of the first or second ion populations accumulated in the chamber of the ion trap.

15. The method of claim 1, wherein at least one of the first ion population or the second ion population is kinetically cooled.

16. An apparatus for analyzing molecules, the apparatus comprising:

a linear ion trap (LIT), configured to:

accept and store a first population of ions;

transmit a second population of ions through the first population of ions; and, a mass analyzer, wherein one of the first population or the second population is analyzed by the mass analyzer.

17. The apparatus of claim 16, wherein the at least one of the first or second population of ions is produced by an electrostatic ion (ESI) generator.

18. The apparatus of claim 16, wherein at least one of the first or second population of ions is produced by a APCI (atmospheric pressure chemical ionization) generator.

19. The apparatus of claim 16, wherein at least one of the first of second population of ions is produced by a sampling glow discharge ionization (ASGDI) source.

20. The apparatus of claim 16, wherein the mass analyzer further comprises a LIT operating in a mass-selective axial ejection (MSAE) mode.

21. The apparatus of claim 16, wherein the mass analyzer is any one of an ion trap, a time-of-flight mass spectrometer, an ORBITRAP mass spectrometer, a quadrupole mass filter, or an ion cyclotron resonance mass spectrometer.

22. The apparatus of claim 16, wherein the first population of ions and the second population of ions are introduced substantially axially to the LIT.

23. The apparatus of claim 16, wherein the first population of ions is radially introduced to the LIT and the second population of ions is axially introduced to the LIT.

24. The apparatus of claim 23, wherein the first and second ion populations are introduced simultaneously.

* * * * *